United States Patent [19]

Tanaka et al.

[11] 4,077,438

[45] Mar. 7, 1978

[54] WEFT CUTTING DEVICE FOR LOOMS

[75] Inventors: Shigenori Tanaka, Hachioji; Akio Tojo, Higashi-murayama; Akio Shindo, Fuchu; Kimimasa Ohnishi, Tokyo, all of Japan

[73] Assignee: Nissan Motor Company, Limited, Japan

[21] Appl. No.: 744,421

[22] Filed: Nov. 23, 1976

[30] Foreign Application Priority Data

Jun. 25, 1976 Japan ..... 51-83680

[51] Int. Cl.[2] ..... D03D 49/70

[52] U.S. Cl. ..... 139/302; 139/429

[58] Field of Search ..... 139/429, 170.4, 263, 139/265, 302, 303

[56] References Cited

U.S. PATENT DOCUMENTS

| | | | |
|---|---|---|---|
| 741,749 | 10/1903 | Wattie | 139/303 |
| 3,273,603 | 9/1966 | Llado | 139/303 |
| 3,451,440 | 6/1969 | Golobart | 139/303 |
| 3,903,932 | 9/1975 | Camprubi | 139/303 |

FOREIGN PATENT DOCUMENTS

| | | | |
|---|---|---|---|
| 2,338,067 | 1/1975 | Germany | 139/302 |

*Primary Examiner*—Henry S. Jaudon

*Attorney, Agent, or Firm*—Robert E. Burns; Emmanuel J. Lobato; Bruce L. Adams

[57] ABSTRACT

A pair of normally open scissor blades, one fixed the other movable, is mounted on the face of a reed. A pressure applying member closes the blades, via a cam mechanism, at a predetermined position of the reed to sever a weft yarn.

9 Claims, 13 Drawing Figures

WEFT CUTTING DEVICE FOR LOOMS

BACKGROUND OF THE INVENTION

This invention relates to a weft cutting device for a loom, particularly adapted for use with a shuttleless, fluid weft injection type.

It is usual in this type of loom to sever the weft thread after each insertion into the shed, forming a selvage as the cloth is fabricated.

In one such known weft cutting device a thread cutter is fixed to and movable together with a reed frame. As the reed is moved forward for beating, the thread cutter is also moved toward the fell of cloth, whereat a suitable pressure applying member fixedly mounted on the loom frame urges the cutter blade to cut off the weft thread. This results in that the weft thread is cut off immediately before the occurrence of beating. Since the weft thread is not yet tightly grasped by the warp threads before beating, it is often skewed or tensioned in such a way during cutting that information of a neat, uniform and firm selvage is difficult.

Another known weft cutting device employs a thread cutter which is not directly fastened to the reed frame but is movable in relation with it to timely cut off the weft thread at the cloth fell. A device of this kind however has the disadvantage that the mechanism for moving the thread cutter separately from but in connection with the reed is undesirably complex.

It may also be pointed out that, particularly when a fabric of high density is woven, the weft thread is bounced back from the cloth fell during beating (so-called "bumping") and the position of the cutter is to be correspondingly adjusted in dependence on the amount of such "bumping".

SUMMARY OF THE INVENTION

It is therefore an object of this invention to provide an improved weft cutting device of a loom which eliminates or alleviates the defects and shortcomings of the known devices as briefly mentioned above.

Another object of this invention is to provide an improved weft cutting device of the aforementioned type in which weft threads inserted into the shed are cut to the width of the cloth at an appropriate time and position, forming an excellent selvage of cloth.

A further object of this invention is to provide an improved weft cutting device of the aforementioned type which is simple in constructon and operation.

A still further object of this invention is to provide an improved weft cutting device of the aforementioned type which is additionally provided with means whereby abnormal and undesired cutting of the weft thread by the weft cutting device is prevented.

In accordance with this invention, the aforementioned and other objects are achieved by the use of a scissor type thread cutter with a fixed blade and a movable blade pivotally movable toward and away from the fixed blade, both located on the reed frame, and a pressure applying member located in opposition to the movable blade and movable in relation to the reed to apply pressure to the movable blade of the cutter for cutting. This arrangement has the advantage that the timing of displacing the pressure applying member and therefore of cutting the weft thread is appropriately so selectable that the thread is cut after being firmly held by the warps by beating.

BRIEF DESCRIPTION OF THE DRAWINGS

Further various objects, features and advantages accompanying with the weft cutting device of this invention will become apparent and clearly pointed out in the following detailed explanation of a preferred embodiment, reference being made to the accompanying drawings, in which.

DESCRIPTION OF THE PREFERRED EMBODIMENTS

Figure 1:
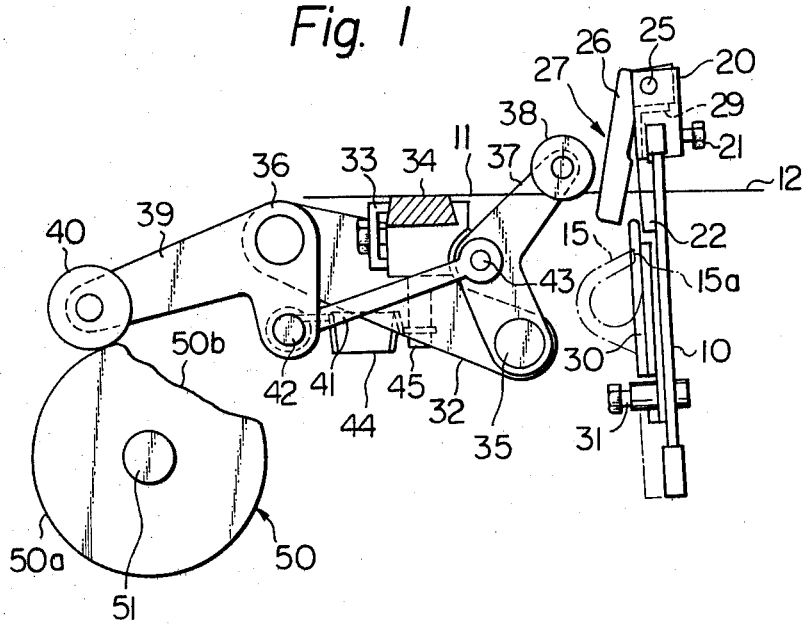
FIG. 1 is an elevation view partly in section, of the preferred embodiment of this invention.

Throughout the FIGS. 1 to 6, a reed of any known type is shown with a reed frame 10. Designated by numeral 11 is a woven cloth and by 12 warp thread. The weft thread 13 is inserted into the shed via an air jet blown out of an air nozzle 14. For correct insertion of weft threads, multiple thread guide elements 15 are arranged integrally on the front face of the reed 10 at a certain interval. The reed 10 moving forwardly and downwardly beats up the inserted weft thread, whereupon the weft leaves the guide elements 15 passing through the small gap 15*a* and is formly held in position of the fell of cloth F.

The construction described hereinbefore can be seen in any common type of loom while the hereinafter description will give a clear idea of the construction according to this invention.

A rectangular bracket 20 is detachably fastened to the upper portion of the reed frame 10 by fastening means 21. The bracket 20 carries a fixed blade 22 which extends downwardly from the bracket 20 along the front face of the reed 10. The bracket 20 also carries two spaced support members 23 and 24 upwardly projecting therefrom. Between the support members 23 and 24 is spanned a stud 25 on which a movable blade 26 is pivotally mounted. The movable blade 26 thus forms a scissor type cutter 27 with the fixed blade 22. The movable blade 27 is preloaded by a compression spring 28 wound around the stud 25 with the ends fixed to the support member 24 and the movable blade 26 respectively to urge the blade 26 into contact with the side face of the fixed blade 22. The spring 28 serves also as a torsion spring which applies a preload to the movable blade 26 for its pivotal movement in a clockwise direction in FIG. 1. The pivotal movement of the blade 26 is limited by a stop 29 integral with the bracket 20 to maintain the cutter 27 at a certain open position as in FIG. 1 or 3.

Figure 5:
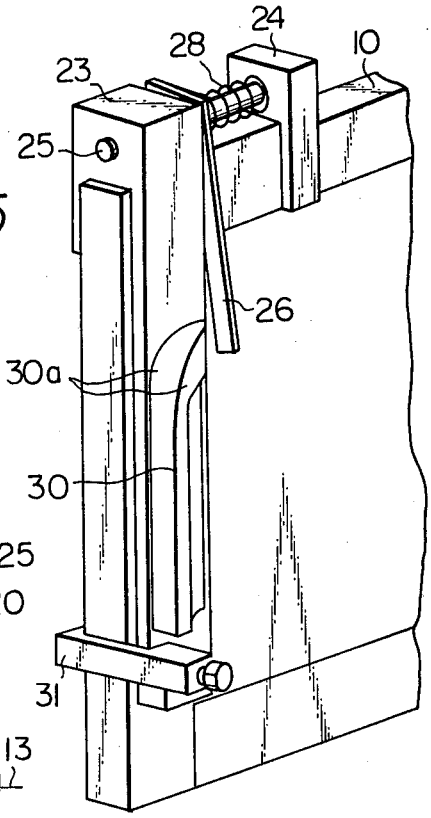
FIG. 5 is an enlarged perspective view showing the thread cutter provided on the reed frame according to the embodiment above.

As best seen in FIG. 5, the support member 23 is vertically elongated and carries on its front face an elongate thread guide member 30. The lower end of the support member 23, with the guide member 30, is fastened to the lower portion of the reed frame 10 by fastening means 81. To guide the thread correctly between the blades 22 and 26, the guide member 30 is formed with a curved top surface 30*a* like a back of spoon. The guide member 30 is so positioned that the curved surface 30*a* overlaps the lower end portion of the cutter 27 when viewed from the side of the reed frame 10. Thus, the weft thread 13 just leaving the curved surface 30*a* of the guide member is directy introduced into a space between the blades 22 and 26.

Figure 2:
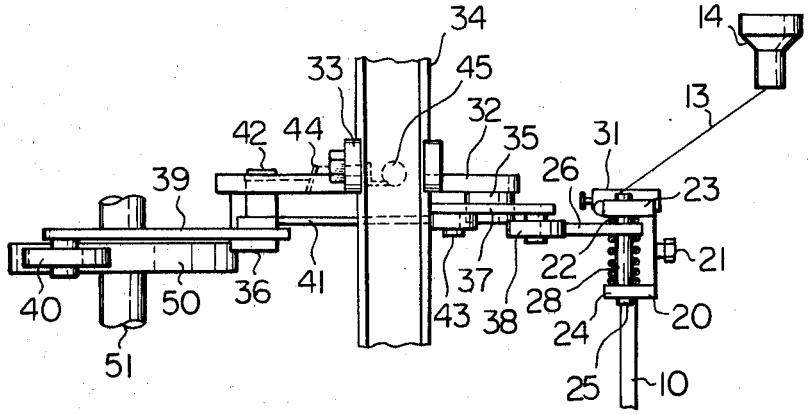
FIG. 2 is a top plan view of FIG. 1.

Pressure applying means to provide cutting movement of the movable blade 26 is hereinafter described with particular reference to FIGS. 1 and 2. As shown, an elongate bracket 32 is located in front of the reed 10 and is secured at its upper periphery to the bottom face of a clamp member 33 which clamps a conventional temple bar 34. The bracket 32 fixedly carries two shafts 35 and 36 respectively on the opposite longitudinal ends thereof. An angled lever 3 is at one end mounted rotatably on the shaft 35. The other end of the lever 37 carries thereon a cylindrical pressure applying member 38 located adjacent and in opposition to the movable blade 26 as seen in FIG. 1. On another shaft 36 rotatably mounted at an elbow portion is another angled lever 39, one end of which fixedly carries a cam follower 40 of roller type. An elbow portion of the lever 37 and the other end of the lever 39 are interconnected by means of a connecting rod 41, the opposite ends of which are pivotally carried on pins 42 and 43 respectively on the levers 39 and 37. The lever 39 is preloaded in the counter-clockwise direction by means of a tension spring 44 born between a pin 45 fixed to the bottom of the bracket 32 and the pin 42, for the purpose as will be described.

A cam 50, with a generally circular raised surface 50*a* and a lowered surface 50*b*, is fixedly mounted on a rotary shaft 51 which is rotatable in synchronism with the main or crank shaft (not shown) of the loom. The cam follower 40 constantly engages any of the raised and lowered cam surfaces by the action of the aforementioned spring 44. As long as the cam follower 40 is in engagement with the raised surface 50*a*, the member 38 is in the remotest position with respect to the reed 10 and does not contact the movable blade 26 even when the reed is in the foremost position. If the cam follower 40 is brought into contact with the lowered surface 50*b*, the member 38 contacts the movable blade 26 and urges it to a closed cutting position overlapping the fixed blade 22 when the reed 10 is nearly in the foremost position.

Figure 3:
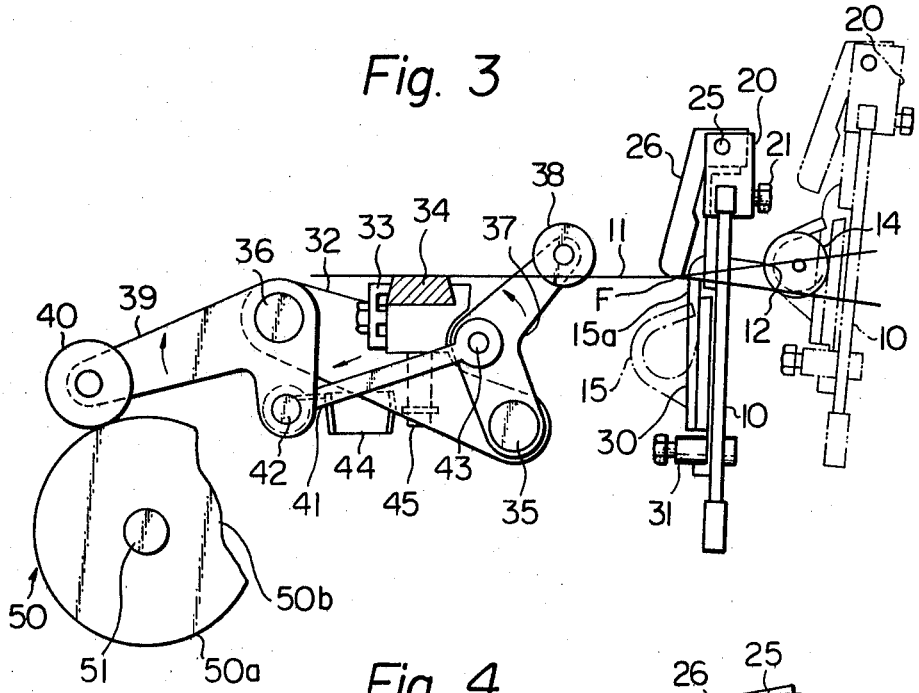
FIGS. 3 and 4 are views similar to FIG. 1 but illustrating different modes of operation.

In operation, as the reed 10 starts to move forwardly for beating, the inserted weft thread escapes from the guide member 15 as described before, and then contacts the curved guide surface 30*a* of the guide member 30. During further forward and downward movement of the reed, the weft is guided along the curved surface 30*a* of the guide member and slips off the surface 30*a* into the space between the blades 22 and 26. Since however the cam follower 40 engages the raised surface 50*a* of the cam 50, the movable blade 26 is yet maintained in the open position, preventing its cutting operation. The condition hereinafter described is illustrated in FIG. 3.

Figure 4:
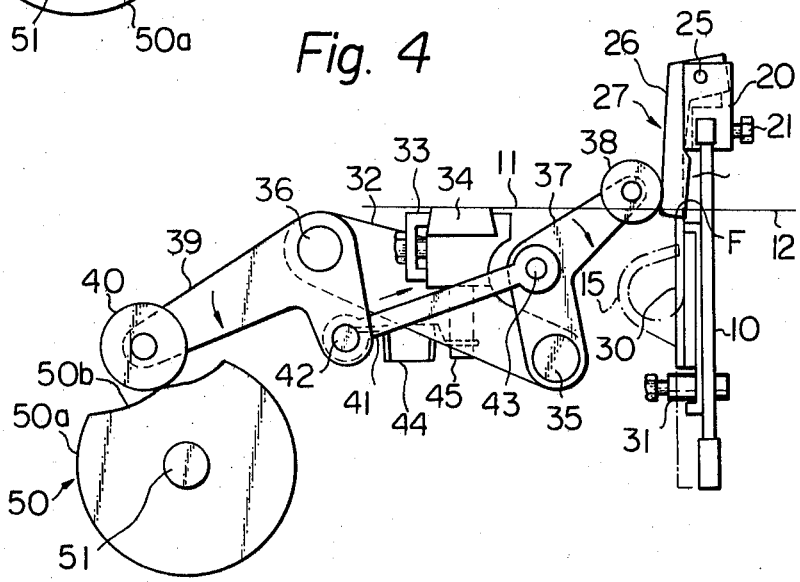

When the reed reaches the foremost position to accomplish beating, the cam follower 40 engages the terminal portion of the raised surface 50*a* (FIG. 1). As soon as the reed 10 is moved rearward after beating, the cam follower 40 is brought into contact with the lowered surface 50*b*. This permits the angled lever 3 to swing about the shaft 36 in the counterclockwise direction. Swinging movement of the lever 39 is transmitted to the angled lever 37 by way of the connecting rod 41 so that the lever 37 is then swung about the shaft 35 in the clockwise direction. The member 38 is thus shifted to contact the movable blade 26 and applies a pressure thereto. The blade 26 is then pushed to the closed position, whereupon the weft thread between the two blades is severed, as shown in FIG. 4.

After this operation has been accomplished, the cam follower 40 again engages the raised surface 50*a* so that the lever 39 is pivoted about the shaft 36 in the clockwise direction. This causes the lever 37 to be swung in the counter-clockwise direction. The cylindrical member 38 resumes the position shown in FIGS. 1 or 3. The movable blade 26 then swings in the clockwise direction under the preload of the spring 28 until it is restrained by the stop 29, and is restored to the open position. The aforedescribed operation is performed upon each weft insertion and the selvage of desirable quality is formed during weaving.

The time at which severing occurs is adjustable by altering the angular relationship of the cam 50 with respect to the loom frame. If the width of cloth is to be changed, bracket 20 and bracket 32 may be adjusted to suitable positions in accordance with the desired width by loosening the fastening member 21 and clamp member 33, the position of the cam 50 being correspondingly changed.

Figure 6:
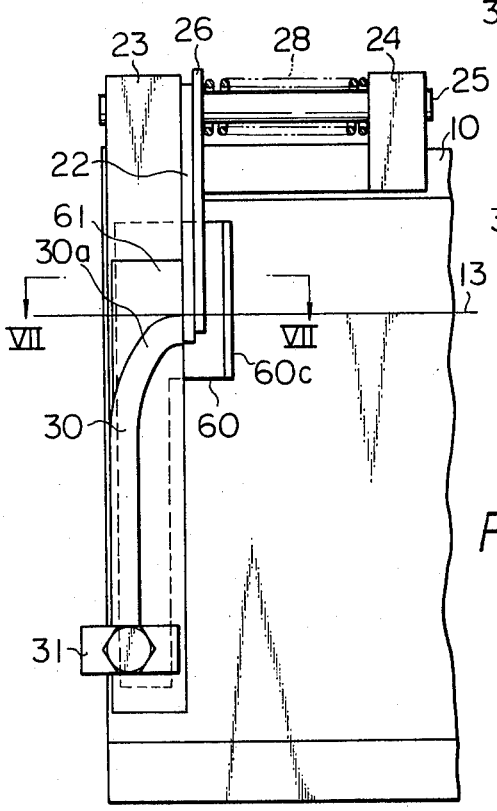
FIG. 6 is a plan view showing the thread cutter provided on the reed frame according to another preferred embodiment.
Figure 7:
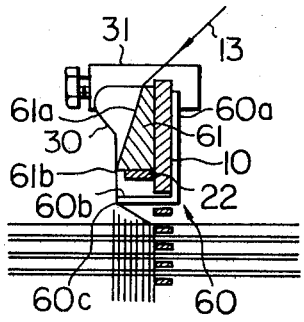
FIG. 7 is a view in section of a portion of FIG. 6 taken along section line VII—VII.
Figure 8:
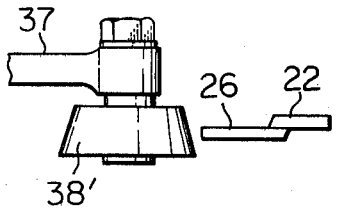
FIGS. 8 and 9 are fragmentary plan and elevation views showing a design alternative of the thread and pressure applying member.
Figure 9:
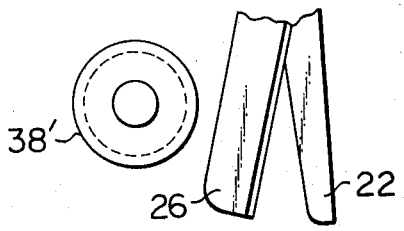

Another preferred embodiment is described hereinafter in connection with FIGS. 6 and 7.

Filament yarns, for instance, of acetate or rayon have a property that they are liable to break on slight contact with the sharp edge of any solid material, not necessarily of a blade of cutting expedient. Since in this invention a fixed blade is secured directly to the reed, the filament yarns may eventually contact the fixed blade, resulting in abnormal breaking of the weft yarns. The embodiment shown in FIGS. 6 and 7 proposes a cutter with a thread protecting element to avoid this undesirable effect. As shown, the inverted-L-profiled thread protector 60, preferably made of wood, has a longer leg 60*a* located along the rear face of the reed and a shorter leg 60*b* located between the fixed blade 22 and the fell of cloth. The front end 60*c* of the shorter leg 60*b* projects forwardly of the cutting edge 22*a* of the fixed blade 22. The longer leg 60 extends downwardly and at its lower portion is fastened to the reed frame together with the weft guide member 30 by means of the fastening means 31. The filament weft 13 is thus carried on the projected forward end 60*c* of the thread protector 60 and is prevented from contacting the edge of the fixed blade 22.

By provision of the thread protector 60, the weft thread has to sharply turn at the forward end 60*c* of the protector. Accordingly, the thread strongly rubs against the forward end 60*c* resulting again in easy breakability. To eliminate this shortcoming, in accordance with this embodiment, there is provided a guide block 61 formed by upwardly extending a portion of the thread guide member 30. As best seen in FIG. 7, the guide block 61 is formed with a tapered surface 61*a* which is tapered toward the fastening member 31. The corner end 61*b* of the guide block 61 is projected forward of the edge 22*a* of the fixed blade and is substantially aligned with the forward end 60*c* of the protector 60. The thread is then guided along a gentle curve drawn by the tapered surface 61*a* the corner end 61*b* of the guide block 61 and the forward end 60*c* of the protector 60.

Figure 10:
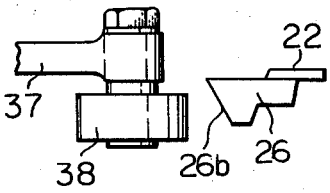
FIGS. 10 and 11 are fragmentary plan and elevation views showing another design alternative of the thread cutter and pressure applying member.
Figure 11:
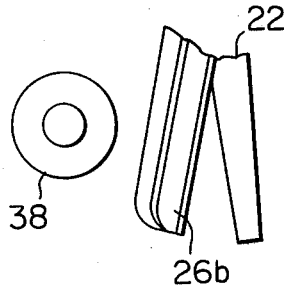

FIGS. 8 to 11 illustrate design alternatives of the cylindrical pressure applying member and the movable blade with respect to their configuration. Example in FIGS. 8 and 9 utilizes a taper-cylindrical member 38′, the oblique surface of which engages the back 26*b* of the blade. In the example of FIGS. 10 and 11, the pressure applying member 38 is of usual cylindrical shape and instead, the back 26*b* of the movable blade 26 is formed with an oblique surface. In each example referred to, the movable blade is urged to the fixed blade with the aid of component forces acting on the oblique surface of the pressure applying member or of the movable blade. An amplified pressure force to urge the movable blade to the fixed blade is therefore utilized in these examples.

Figure 12:
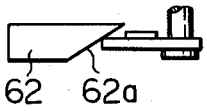
FIGS. 12 and 13 are fragmentary plan and elevation views showing a modified example of the thread cutter and preload means therefor.
Figure 13:
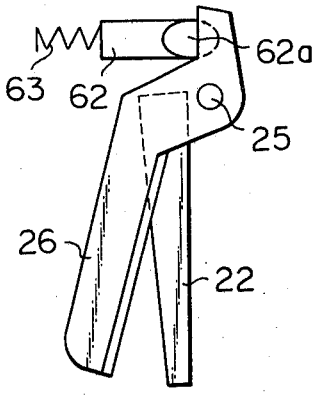

In FIGS. 12 and 13, the movable blade 26 has an upward extension in contact with an oblique surface 62*a* of a cylindrical member 62 is constantly loaded by a compression spring 63 so that the movable blade 26 is pressed against the side face of fixed blade 22.

What is claimed is:

1. Weft cutting device for a loom having a crank shaft and a reed, comprising a scissor type cutter assembly including a fixed blade mounted on a front face of the reed and a movable blade having an upper end pivotally mounted on the reed in pressure contact with the side face of said fixed blade said movable blade being preloaded by a spring to an open position, thread guide means for guiding a weft thread to a space between the fixed blade and the movable blade in said open position, and pressure applying means in front of the movable blade and movable in relation with the movement of the reed for applying a pressure to said movable blade to urge same to a closed position in which the weft thread is cut off.

2. Weft cutting device as defined in claim 1, in which said pressure applying means comprises a cylindrical pressure applying member located in opposition to said movable blade, a cam member fixedly mounted on a shaft rotatable in synchronism with the crankshaft of the loom and having a cam surface consisting of a raised porton and a lowered portion, a cam follower in pressure contact with the cam surface of said cam member and a linkage interconnected between said pressure applying member and said cam follower for transmitting camming motion of said cam and cam follower to said pressure applying member, wherein the arrangement is such that, when the cam follower engages the raised portion of said cam member, the pressure applying member is spaced at a certain distance from the movable blade at the foremost position of the reed, while as soon as the reed is moved rearwardly, the cam follower engages the lowered portion of said cam member to bring the pressure applying member into pressure contact with the movable blade.

3. Weft cutting device as defined in claim 2, in which said cylindrical pressure applying member has an oblique surface engageable with the back of said movable blade.

4. Weft cutting device as defined in claim 2, in which the back of said movable blade has an oblique surface engageable with the cylindrical surface of said pressure applying member.

5. Weft cutting device as defined in claim 2, in which said linkage comprises a fixed bracket extending between said pressure applying member and said cam follower to be adjustable transversely of the loom in accordance with a width of cloth to be woven, said bracket fixedly carrying a first shaft and a second shaft on the opposite longitudinal ends thereof, a first angled lever having one end rotatably mounted on said first shaft, the other end fixedly carrying said pressure applying member and an elbow portion, a second angled lever having an elbow portion rotatably mounted on said second shaft, one end carrying said cam follower and the other end, a connecting rod at the opposite ends pivotally mounted respectively on said elbow portion of the first lever and the other end of said second lever, and means to apply a preload to said second lever to keep said cam follower in pressure contact with the cam surface of said cam member.

6. Weft cutting device as defined in claim 1, in which said thread guide means includes an elongate guide member located vertically on the front face of the reed outside of said cutter assembly, said guide member having an upper end portion overlapping the lower portion of said cutter assembly and formed with an upwardly curved surface to correctly guide the thread into the space between said blades.

7. Weft cutting device as defined in claim 6, further comprising a thread protecting element located between said fixed blade and the fell of cloth and having a front end projecting forwardly of the cutting edge of the fixed blade, said front end carrying thereon the weft thread to protect same from contacting with the edge of the fixed blade.

8. Weft cutting device as defined in claim 7, further comprising a thread guide block located adjacent the fixed blade on the side opposite to said thread protecting element and having a tapered thread guide surface, the foremost end of which is projected forwardy of the cutting edge of the fixed blade.

9. Weft cutting device for a loom having a crank shaft and a reed, comprising in combinaton a scissor type cutter assembly including a fixed blade mounted on a front face of the reed and a movable blade having an upper end pivotally mounted on the reed in pressure contact with the side face of said fixed blade, said movable blade being preloaded by a spring to an open position, weft thread guide means for guiding a weft thread to a space between the fixed blade and the movable blade in said open position, means for protecting the weft thread from contacting the edge of said fixed blade, and pressure applying means in front of the movable blade and movable in relation to the movement of said reed for applying a pressure to said movable blade to urge same to a closed position in which the weft thread is cut off.

* * * * *